US005553544A

United States Patent [19]

Ramsay

[11] Patent Number: 5,553,544

[45] Date of Patent: Sep. 10, 1996

[54] PLATE CYLINDER

[75] Inventor: Bertrum S. Ramsay, Wolfboro, N.H.

[73] Assignees: Heidelberg Harns Inc., Dover, N.H.; Heidelberger Druckmaschinen AG, Heidelberg, Germany

[21] Appl. No.: 420,392

[22] Filed: Apr. 12, 1995

[51] Int. Cl.[6] ..... B41F 21/00

[52] U.S. Cl. ..... 101/415.1; 101/409

[58] Field of Search ..... 101/415.1, 477, 101/409, 410, 378, 383

[56] References Cited

U.S. PATENT DOCUMENTS

| | | | |
|---|---|---|---|
| 3,393,638 | 7/1968 | Böhm | 101/415.1 |
| 4,006,686 | 2/1977 | Ackerman | 101/415.1 |
| 4,250,810 | 2/1981 | Fowler et al. | 101/410 |
| 4,577,560 | 3/1986 | Banike | 101/415.1 |
| 4,742,772 | 5/1988 | Grose | 101/415.1 |
| 5,284,093 | 2/1994 | Guaraldi et al. | 101/415.1 |

*Primary Examiner*—Christopher A. Bennett
*Attorney, Agent, or Firm*—Kenyon & Kenyon

[57] ABSTRACT

A plate cylinder of a rotary printing press having a cylindrical outer surface which forms a resting surface for a printing plate which is to be clamped thereon, and having a receiving gap which is open towards the outer surface and extends transversely to the circumferential direction of the cylinder, within which gap there is a clamping device for the printing plate which has a displaceable clamping element, is disclosed. This clamping element is displaceable, for the fastening or loosening of the printing plate, along a path concentric to the axis of rotation of the plate cylinder in the circumferential direction of the cylinder.

12 Claims, 4 Drawing Sheets

PLATE CYLINDER

FIELD OF THE INVENTION

The present invention relates generally to printing presses and more specifically to a plate cylinder having a cylindrical outer surface which forms a resting surface for a printing plate which is to be clamped thereon, and having a receiving gap which is open towards the outer surface and extends transversely to the circumferential direction of the cylinder, within which gap there is a clamping device for the printing plate which has a displaceable clamping element.

BACKGROUND OF THE INVENTION

A plate cylinder of the aforementioned type is known from U.S. Pat. No. 5,284,093. In a receiving gap in the plate cylinder, a clamping element of a clamping device is arranged displaceably in order to fasten a printing plate on the outer surface of the plate cylinder by clamping the regions of the starting and ending edges of the printing plate. For this purpose, the regions of the starting and end edges of the printing plate are bent in approximately a radial direction and extend into a clamping-slot space, the clamping being effected by corresponding displacement of the clamping element of the clamping device. In its loosened condition, the clamping element extends beyond the periphery of the outer surface of the printing-plate cylinder. When the clamping process takes place, the clamping element moves along the radial direction into the receiving gap, the clamping element in the clamped condition being more or less flush with the rest of the surface of the plate cylinder, depending on the clamp end position and the thickness of the printing plate used. If a relatively short printing plate is used, the clamping element may extend outward beyond the outer surface of the plate cylinder in the clamped condition. With a printing plate which is somewhat longer than the normal size, the clamping element may move so far into the plate cylinder that its surface is lower than the resting surface of the plate cylinder. Furthermore, the clamping force and also the dimensional accuracy of spring elements which are used to clamp the regions of the starting and end edges of the printing plate determine what position the clamping element in the firmly clamped condition assumes relative to the outer surface of the plate cylinder. There is thus no assurance that the clamping element will be flush with the outer surface of the plate cylinder, resulting in uneven travel of the plate cylinder. This can lead to smearing or other undesireable effects during printing.

SUMMARY OF THE PRESENT INVENTION

An object of the present invention is to provide a plate cylinder of a rotary printing press of the aforementioned type in which the above-indicated disadvantages do not occur.

The present invention therefore provides a plate cylinder of a rotary printing press comprising: a cylindrical body having an outer surface and having a receiving gap which is open towards the outer surface and extends transversely to a circumferential direction of the plate cylinder; and a clamping element located in the gap, the clamping element moveable along a circumferential path for the fastening or loosening of a printing plate. A printing press having the plate cylinder as described above is also provided.

Therefore, the clamping element for the fastening or loosening of the printing plate is displaceable in the circumferential direction of the cylinder along a path concentric to the axis of rotation of the plate cylinder. Due to this predetermined path of displacement, there is no radial displacement of the clamping element upon the loosening or clamping of the printing plate; in other words, it always remains in the same position, with respect to its radial position, and to this extent is not affected by the length of the printing plate used or the development or condition of spring elements which are preferably employed and which act on the region of the starting and end edges of the printing plate which is to be fastened. The clamping element bridges over the receiving gap—except for a slot serving for its displacement and clamping—so that the construction provides a minimum sized slot. The fixing of the regions of the starting and end edges of the printing plate is effected—with the interpositioning of the aforementioned spring elements or non-resilient printing parts—by means of one and the same clamping element.

In accordance with a further development of the invention, it is provided that the clamping element is displaceable along a support surface which extends concentrically to the axis of rotation of the plate cylinder. In particular, it can be provided that the clamping element have a resting surface which cooperates with the support surface and which also extends concentrically to the axis of rotation of the plate cylinder. Therefore, the clamping element forms a portion of a circular annular cylinder in such a manner that its concavely curved resting cylinder lies on the convexly curved support surface of the plate cylinder, as a result of which the concentric path in the circumferential direction of the cylinder upon displacement of the clamping element is preferably obtained.

In accordance with a preferred embodiment of the invention, the clamping element has a support surface which extends concentrically to the axis of rotation of the plate cylinder and is flush with the resting surface of the plate cylinder in the circumferential direction of the cylinder. This means that the support surface passes flush into the resting surface and thus forms an optimal support for the printing plate without any step-shaped or oval regions or regions of unsuitable dimensions being present. This condition is realized in all cases, regardless of the position of the clamping element, and can therefore not exert a negative influence on the travel and/or printing properties of the plate cylinder.

It is furthermore advantageous for the clamping element to be acted on by the force of a first spring device in the circumferential direction for the fastening of the printing plate. The clamping process is thus effected by means of the first spring device, which forces the clamping element into its clamping position along the concentric path.

It is particularly advantageous if the clamping element is forced, by the force of a second spring device, in a radial or approximately radial direction onto the support surface. In this way, the radial position of the clamping element is preestablished in a reproducible manner. Nevertheless, regardless of this pressing of the clamping element onto the support surface, a movement of displacement of the clamping element in a circumferential direction for the loosening or reproducing of the clamping position is possible.

In accordance with a preferred embodiment of the invention, a pull-coupling device has one end pivoted in swingable manner to the clamping element, while its other end is acted on by a second spring device. This pull-coupling device assures a close fit between the resting and support surfaces and also permits the aforementioned displacement of the clamping element in a circumferential direction.

In particular, it can be provided that a double-lever arrangement is arranged swingably on the other end of the pull-coupling device, said arrangement being acted on by the second spring device. The double-lever arrangement is swingably mounted between its end regions, one arm of the double lever arrangement acting on the pull-coupling device and the other arm being acted on by the second spring device in such a manner that the double-lever arrangement turns around its pivot point in such a manner that a pulling force is exerted on the clamping element by the pull-coupling device.

In order to be able to assume a loosened position by displacement of the clamping element against the action of the first spring device, a drive device is provided which can be developed, in particular, as a pneumatic or hydraulic piston-cylinder unit. The drive device preferably acts on the pull-coupling device transverse to its direction of pull in order to produce this loosened position. If the drive device acts on the pull-coupling device transverse to its direction of pull, it will be displaced in circumferential direction—without its pulling action being impaired—carrying the clamping element along with it.

BRIEF DESCRIPTION OF THE DRAWINGS

The drawings show the invention on the basis of the preferred embodiment, in which.

DETAILED DESCRIPTION

Figure 1:
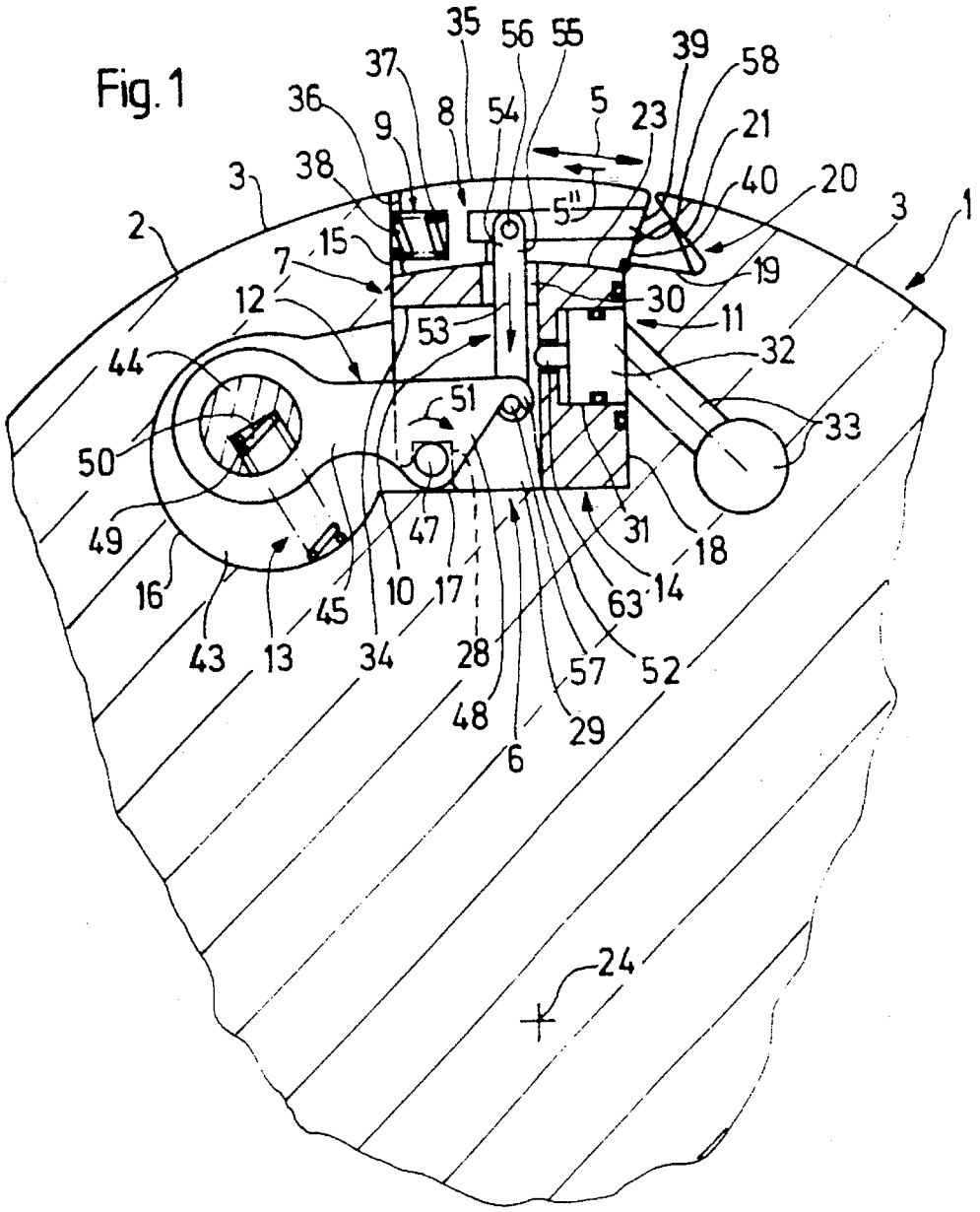
FIG. 1 is a cross section through a plate cylinder in the region of a clamping device.

FIG. 1 shows—in sectional view—a portion of a plate cylinder 1 of a rotary printing press (not shown). The plate cylinder 1 has a circular-cylindrical outer surface 2 which forms a resting surface 3 for a printing plate 4 (FIG. 7) which is to be clamped thereon. The plate cylinder 1 has a receiving gap 6 which is open towards the outer surface 2 and extends transversely to the circumferential direction of the cylinder (double-ended arrow 5), in which gap there is a clamping device 7. The clamping device 7 serves for clamping the regions of the starting and end edges of the printing plate 4.

The clamping device 7 has a clamping element 8, a first spring device 9, a pull-coupling device 10, a drive device 11, a double-lever arrangement 12, as well as a second spring device 13. Furthermore, a mounting element 14 is provided, it being located within the receiving gap 6 and serving as a slide mounting for displacement of the clamping element 8 in the circumferential direction (along the double-ended arrow 5).

Viewed in cross section, the receiving gap 6 has a contour which—starting at the resting surface 3—is first developed as a radially extending flat wall region 15 which passes into the substantially circular cavity wall 16. Adjoining the cavity wall 16 is a flat-bottomed wall 17 from which—again extending approximately in a radial direction of the plate cylinder—there extends another wall region 18. The latter passes into a bottom wall 19 which extends approximately in the circumferential direction and forms the bottom of a clamping slot space 20. Adjoining the bottom wall 19 there is a clamping wall 21 which has a secant-shaped course with respect to the cross section of the plate cylinder 1 and passes into the resting surface 3. The wall regions 15 and 18 are preferably parallel to each other.

The mounting element 14 is so inserted in the receiving gap 6 that it is located between the wall regions 15 and 18 and rests on the bottom wall 17. It is held in this position by suitable means (for instance, screws).

Figure 2:
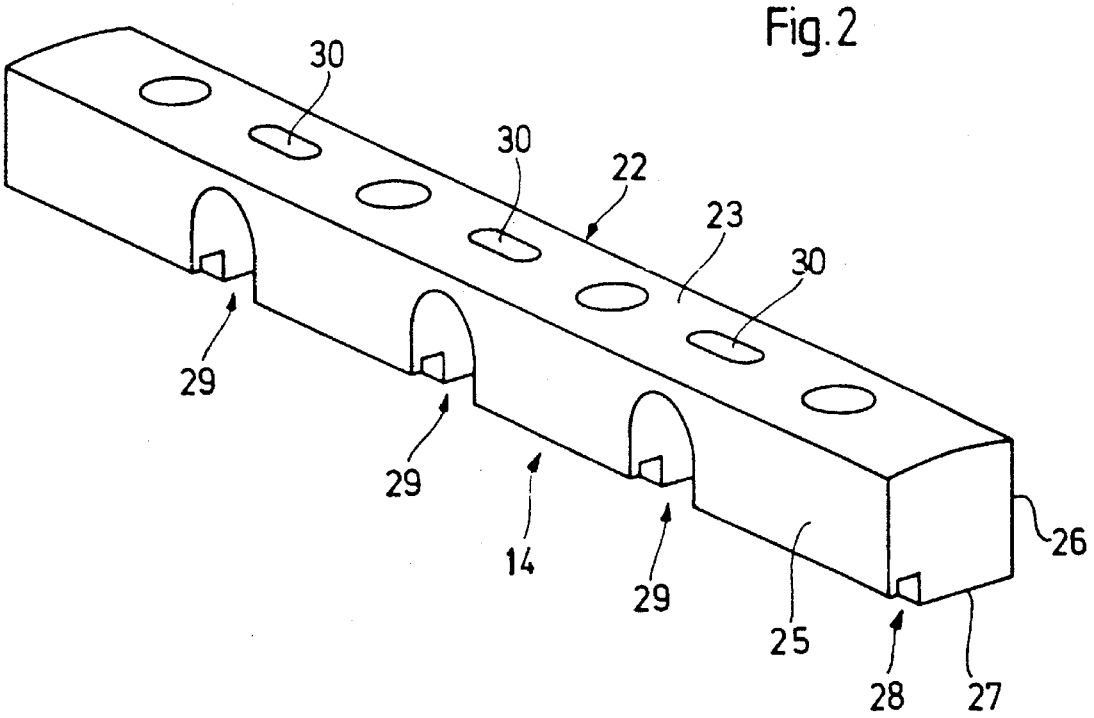
FIG. 2 is a mounting element of the clamping device.

In accordance with FIG. 2, the mounting element 14 is developed in the form of a mounting strip 22 which has a convex support surface 23 which—in accordance with FIG. 1—extends partially circumferentially about the axis of rotation 24 of the plate cylinder 1. Furthermore, the mounting strip 22 has two side walls 25 and 26 which are opposite and parallel to each other and—in the installed condition—rest against the wall regions 15 and 18. From the flat bottom side 27 of the mounting strip 22 there extends a groove 28 which is present over the entire length of the mounting strip 22.

Figure 3:
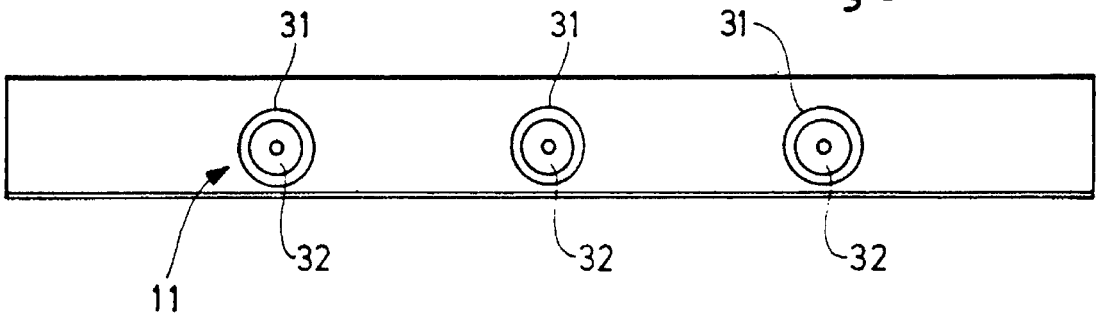
FIG. 3 is a rear view of the mounting element of FIG. 2.

In the side wall 25 there are cutouts 29 spaced apart from each other over the length of the mounting strip 22, into which cutouts 29 openings 30 which extend through the support surface 23 debouch. The cutouts 29 pass—seen in the direction towards the side wall 26—into receiving holes 31 (FIG. 3) in which pneumatic piston-cylinder units 32 are arranged. These piston-cylinder units 32 are part of the drive device 11. The drive device 11 is provided with compressed air via gaps 33 (FIG. 1).

Figure 4:
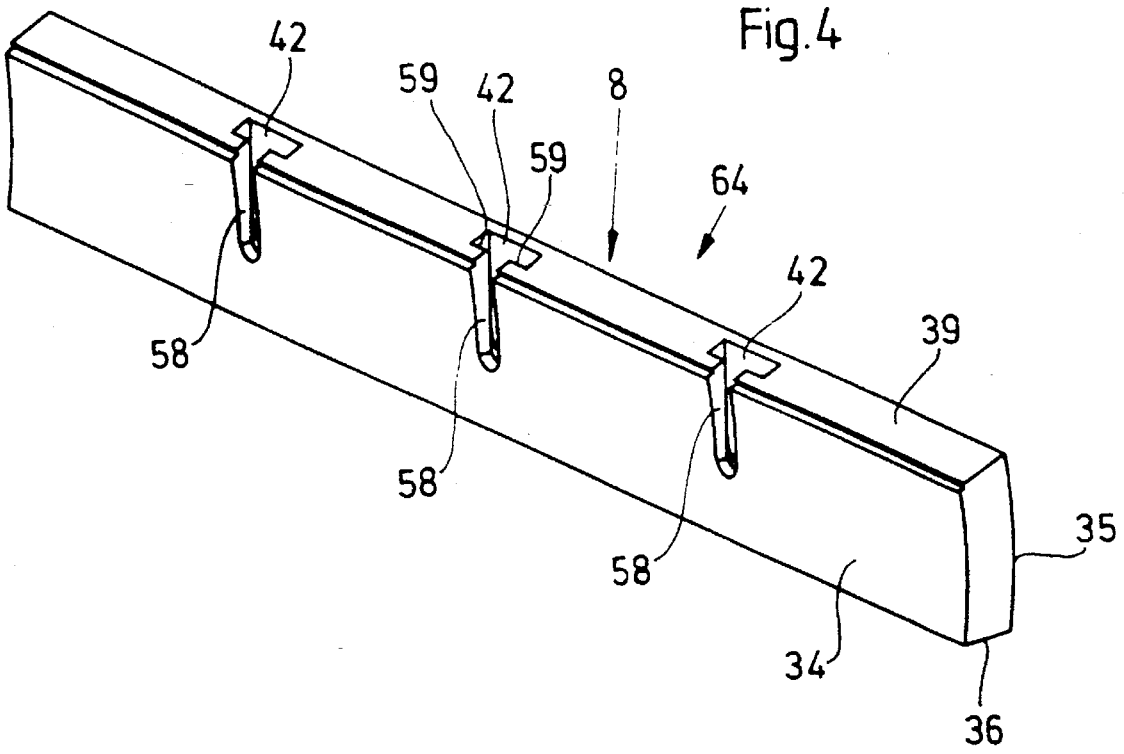
FIG. 4 is a perspective view of a clamping element of the clamping device.

As shown in FIG. 1, the clamping element 8 is mounted—in the direction of the double-ended arrow 5—displaceably on the support surface 23. The clamping element 8 is formed by a portion of a circular annular cylinder 64 and has a concave resting surface 34 (See. FIG. 4) and extends coaxially to the axis of rotation 24 of the plate cylinder 1. Furthermore, the clamping element 8 has a convex support surface 35 and is coaxial to the axis of rotation 24 of the plate cylinder 1 so that it is flush with the resting surface 3 of the plate cylinder 1. Furthermore, the clamping element 8 has a first end wall 36 which—as shown in FIG. 1—extends parallel to the wall region 15 and in which—distributed over the length of the strip-shaped clamping element 8—receiving depressions 37 are arranged which form holes in which coil compression springs 38 of the first spring device 9 are contained. Opposite the first end wall 36, there is a second end wall 39 which forms a clamping wall 40 and forms an angle $\alpha$ with the radial direction designated 41 in FIG. 7.

In accordance with FIG. 4, several, preferably three, T-shaped grooves 42 which are spaced apart from each other extend from the second end wall 39 of the clamping element 8, the grooves being open towards the resting surface 34. The grooves 42 pass somewhat more than one half way through the width of the clamping element 8. They are associated—with respect to their position—with the openings 30 and thus also the cutouts 29 of the mounting element 14.

Figure 5:
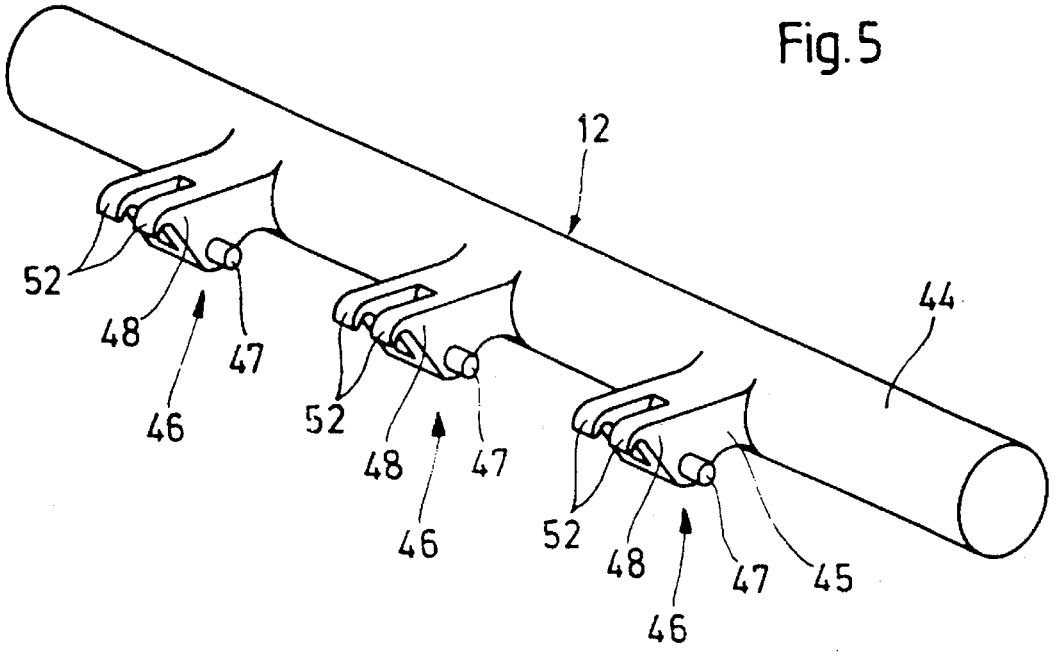
FIG. 5 is a perspective view of a double-lever arrangement of the clamping device.

In the cavity 43 of the receiving gap 6 which is surrounded by the cavity wall 16 there is located the double-lever arrangement 12, which is shown in FIG. 5. It consists of a bar-shaped base-carrier 44 which forms a part of an arm 45 of the double-lever arrangement 12. From the base carrier 44 there extend three brackets 46, each of which has a mounting pin 47. The region of the corresponding bracket 46 which points—starting from the bearing pin 47—in the direction towards the base carrier 44 belongs to the aforementioned arm 45. Another arm 48 of the double-lever arrangement 12 is formed by the corresponding section of the bracket 46 which is located on the other side of the corresponding mounting pin 47. In accordance with FIG. 1, the base carrier 44 has several holes 49 distributed over its length in which there are mounted coil compression springs 50 which belong to the second spring device 13. The coil compression springs 50 rest against the cavity wall 16 and produce a moment of rotation—around the mounting pins 47—in the direction of the arrow 51 shown in FIG. 1. From FIG. 1 it can furthermore be noted that the mounting pins 47 engage into the groove 28 of the mounting element 14, the arms 48 extending into the cutouts 29. Each bracket 46 has at its end a hook-shaped projection 52 with which it acts, with swinging motion, on the pull-coupling device 10 so that the latter is acted on in the direction indicated by the arrow 53.

Figure 6:
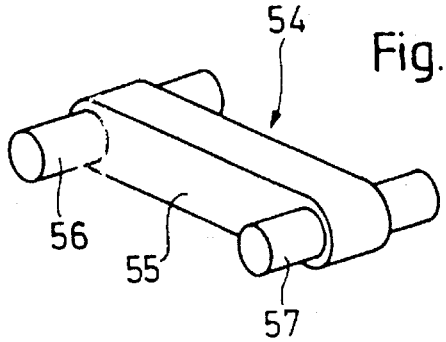
FIG. 6 shows a coupling of a pull-coupling device of the clamping device.

The pull-coupling device 10 is formed by three couplers 54 (FIG. 6), each of which has a lengthwise arm 55 and two transverse arms 56 and 57.

In accordance with FIG. 1, the lengthwise arm 55 of each coupler 54 passes in each case through a gap 58 belonging to the groove 42 and debouching into the resting surface 34 of the clamping element 8, the transverse arm 56 resting on sidewalls 59 of the T-groove 42 (See FIG. 4). The corresponding projection 52 which—as shown in FIG. 5—is fork-shaped, engages behind the corresponding transverse arm 57 of the corresponding coupler 54, whereby a pulling force is exerted, as a whole, by the spring-urged double-lever arrangement 12 via the individual couplers 54, on the clamping element 8 so that its resting surface 34 is pressed against the support surface 23 of the mounting element 14. In this way, a well-defined, radial position of the clamping element 8 in the receiving gap 6 is produced, regardless of its position of shift in the direction of the double-ended arrow 5.

Figure 7:
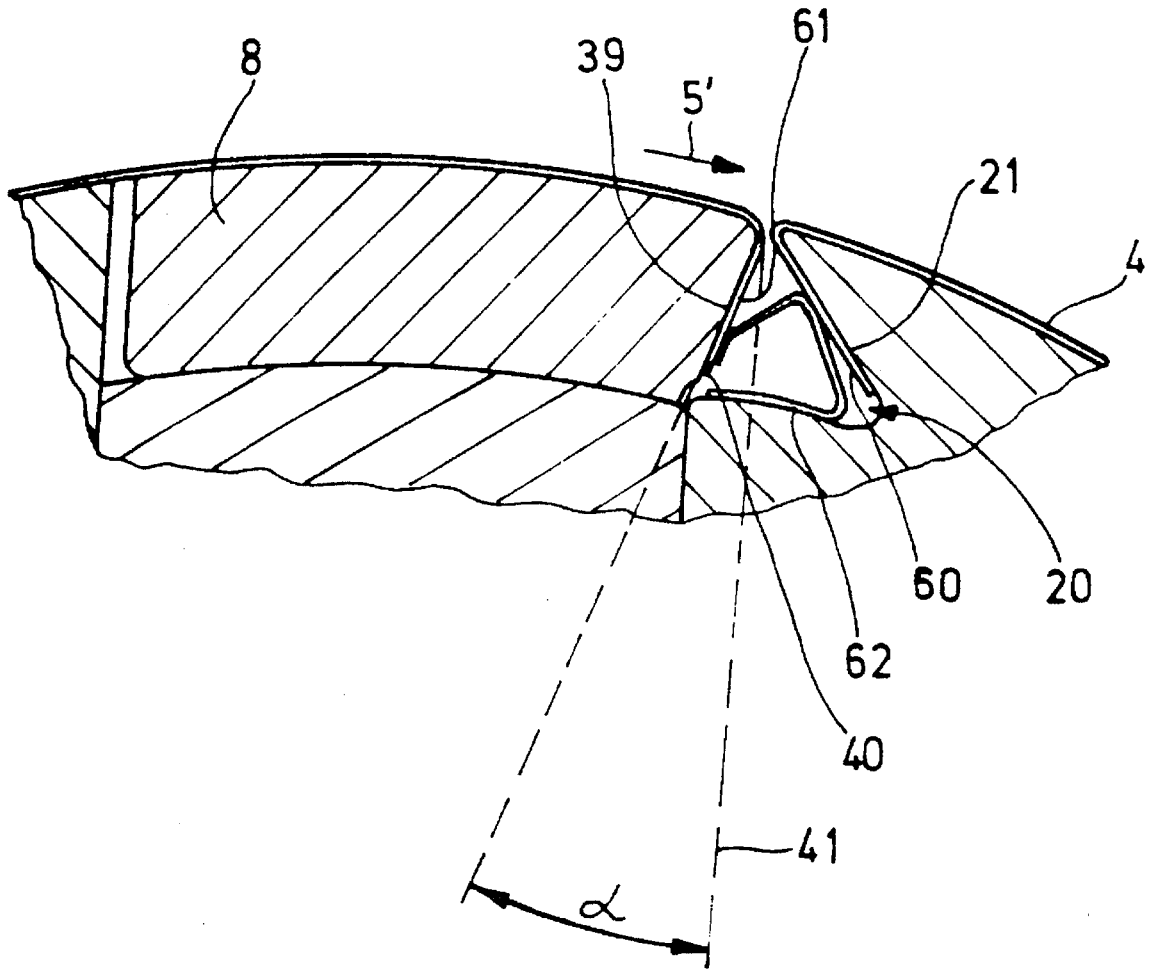
FIG. 7 is a sectional view in the region of the clamping slot of the plate cylinder.

In accordance with FIG. 7, the region of the starting edge 60 of the printing plate 4 is bent in hook shape. This is also true of the region of the end edge 61. The two edge regions 60, 61 lie in the clamping-slot space 20 in such a manner that the region 60 of the starting edge 60 rests on the clamping wall 21 and the region of the end edge 61 lies on the second end wall 39. Within the clamping-slot space 20 there is a substantially U-shaped spring element 62 which serves to act on the edge regions 60 and 61 of the printing plate 4 in order to hold it fast. For fastening, fastening element 8 is displaced—by the coil-compression springs 38—in the direction of the arrow 5' (FIG. 7), as a result of which the clamping-slot space 20 is made smaller and thus the spring element 62 is pressed against the edge regions 60 and 61 of the printing plate 4. In this way, the printing plate 4 is clamped fast on the outer surface 2 of the plate cylinder 1.

If the clamped position is to be released, fluid is conducted via the gaps 33 into the piston-cylinder units 32, as a result of which their pistons 63—as shown in FIG. 1—act transversely on the longitudinal arms 55 of the couplers 54, as a result of which the couplers 54 swing and carry the clamping element 8 along in the direction of the arrow 5". This takes place with the comression of the coil springs 38 of the first spring device 9.

It is understood that while the present invention has been described with respect to the embodiment described above, other embodiments may fall within the scope of the invention.

What is claimed is:

1. A plate cylinder of a rotary printing press comprising:

a cylindrical body having an outer surface and having a receiving gap which is open towards the outer surface and extends transversely to a circumferential direction of the cylindrical body, the cylindrical body having a first wall region defining one end of the receiving gap at the outer surface and a cylindrical body clamping wall defining the other end of the receiving gap at the outer surface;

a clamping element located in the gap, the clamping element having a clamping element clamping wall adjacent to the cylindrical body clamping wall at the outer surface, the clamping element being moveable circumferentially with respect to the cylindrical body for the fastening or loosening of a printing plate; and a first spring device for forcing the clamping element away from the first wall region.

2. The plate cylinder as recited in claim 1 further comprising a mounting element located in the gap radially inward with respect to the cylindrical body from the clamping element, the mounting element having a convex support surface along which the clamping element moves.

3. The plate cylinder as recited in claim 2 wherein the clamping element has a concave resting surface which cooperates with the support surface.

4. The plate cylinder as recited in claim 1 wherein the clamping element has a convex surface which is approximately flush with the outer surface of the plate cylinder in the circumferential direction.

5. The plate cylinder as recited in claim 1 further comprising a drive device for displacing the clamping element circumferentially with respect to the cylindrical body to allow for loosening of the printing plate.

6. The plate cylinder as claimed in claim 1 wherein the the clamping element is formed by a portion of a circular annular cylinder.

7. The plate cylinder as recited in claim 1 wherein the printing plate has a starting edge and an end edge and further comprising a substantially U-shaped spring element for forcing the starting edge and end edge apart.

8. A plate cylinder of a rotary printing press comprising:

a cylindrical body having an outer surface and having a receiving gap which is open towards the outer surface and extends transversely to a circumferential direction of the cylindrical body;

a clamping element located in the gap, the clamping element moveable circumferentially with respect to the cylindrical body for the fastening or loosening of a printing plate; and a second spring device for forcing the clamping element approximately radially inward with respect to the cylindrical body.

9. The plate cylinder as recited in claim 8 further comprising a pull-coupling device attached to the clamping element at one end and acted on by the second spring device at the other end.

10. The plate cylinder as recited in claim 9 further comprising a double-lever arrangement and wherein the pull-coupling device is acted on by the second spring device through the double-lever arragement.

11. A plate cylinder of a rotary printing press comprising:

a cylindrical body having an outer surface and having a receiving gap which is open towards the outer surface and extends transversely to a circumferential direction of the cylindrical body;

a clamping element located in the gap, the clamping element moveable circumferentially with respect to the cylindrical body for the fastening or loosening of a printing plate;

a drive device for displacing the clamping element circumferentially with respect to the cylindrical body to allow for loosening of the printing plate; and a pull-coupling device attached to the clamping element for pulling the clamping element approximately radially inward with respect to the cylindrical body and wherein the drive device acts on the pull coupling device transverse to its direction of pull.

12. The plate cylinder as recited in claim 9 wherein the drive device has at least one pneumatic or hydraulic piston-cylinder unit.

* * * * *

UNITED STATES PATENT AND TRADEMARK OFFICE

CERTIFICATE OF CORRECTION

PATENT NO. : 5,553,544

DATED : September 10, 1996

INVENTOR(S) : Bertrum Scott Ramsay

It is certified that error appears in the above-identified patent and that said Letters Patent is hereby corrected as shown below:

Cover page, [73] should read

-- Assignees: Heidelberg Harris Inc., Dover, N.H.;
Heidelberger Druckmaschinen AG,
Heidelberg, Germany --.

Signed and Sealed this

Twenty-fifth Day of November, 1997

*Attest:*

*Attesting Officer*

BRUCE LEHMAN

*Commissioner of Patents and Trademarks*